US005342728A

United States Patent [19]

Henzel

[11] Patent Number: 5,342,728

[45] Date of Patent: Aug. 30, 1994

[54] STABILIZERS FOR DYE-DONOR ELEMENT USED IN THERMAL DYE TRANSFER

[75] Inventor: Richard P. Henzel, Webster, N.Y.

[73] Assignee: Eastman Kodak Company, Rochester, N.Y.

[21] Appl. No.: 931,806

[22] Filed: Aug. 18, 1992

[51] Int. Cl.[5] ..... B41M 5/26

[52] U.S. Cl. ..... 430/200; 430/201; 503/227; 428/195

[58] Field of Search ..... 430/200, 201; 503/227; 428/195

[56] References Cited

U.S. PATENT DOCUMENTS

| | | | |
|---|---|---|---|
| 4,140,336 | 2/1979 | Maalouf | 428/914 |
| 4,614,521 | 9/1986 | Niwa et al. | 503/227 |
| 4,829,050 | 5/1989 | Henzel et al. | 503/227 |
| 4,847,238 | 7/1989 | Jongewaard et al. | 503/227 |
| 4,946,826 | 8/1990 | Kubo et al. | 503/227 |
| 4,981,748 | 1/1991 | Kawai et al. | 503/227 |
| 5,041,411 | 8/1991 | Chapman et al. | 430/201 |
| 5,192,737 | 11/1991 | Kubodera et al. | 430/201 |
| 5,196,393 | 3/1993 | Kubadera et al. | 430/201 |

FOREIGN PATENT DOCUMENTS

| | | |
|---|---|---|
| 228294 | 7/1987 | European Pat. Off. . |
| 0444641 | 9/1991 | European Pat. Off. . |
| 444641 | 9/1991 | European Pat. Off. . |
| 62-245261 | 10/1987 | Japan . |
| 03-036087 | 2/1991 | Japan . |
| 04-138283 | 5/1992 | Japan . |

*Primary Examiner*—Charles L. Bowers, Jr.
*Assistant Examiner*—Martin Angebranndt
*Attorney, Agent, or Firm*—Harold E. Cole

[57] ABSTRACT

This invention relates to a dye-donor element for thermal dye transfer comprising a support having thereon a dye layer comprising an image dye in a polymeric binder which is non-transferable by heat, and wherein the dye layer also contains an epoxide stabilizer, other than the binder, in an amount of up to about 25% by weight of the binder.

9 Claims, No Drawings

STABILIZERS FOR DYE-DONOR ELEMENT USED IN THERMAL DYE TRANSFER

This invention relates to the use of epoxide stabilizers in dye-donor elements for thermal dye transfer systems.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta or yellow signal. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

An important requirement for any thermal dye-donor element is to maintain performance over its useful lifetime without degradation in the quality of the image. This is particularly important in the case of thermal dye-donor elements that are used for proofing of color images, since the color balance of the final image is of utmost concern to the customer. Any change in the dye-donor element over its lifetime would result in an inability to reproduce the original color of a given image.

Undesirable changes that can occur in dye-donor elements include crystallization of dyes, exudation of materials to the surface of a coating, change in hue of a dye, or dye loss due to thermal decomposition or chemical change. A particularly noticeable problem that can occur in dye-donor elements where there is a plurality of dyes, is selective loss of one or more dyes. In this case, the problem is more severe because the human eye is frequently more sensitive to color balance than color density.

JP 03/036087 describes the use of hindered phenols in heat-sensitive recording materials to improve storage stability. However, these materials were not as effective as the epoxide stabilizers of the invention, as will be illustrated by the comparative tests hereafter.

EP 228,294 relates to dye-donor elements wherein the binder comprises an epoxy resin which is used in an amount of greater than 70 wt % of the total binder composition. However, there is no disclosure in this reference that a smaller amount of epoxy material used with another binder would result in stabilization of the dye layer.

EP 444,641 relates to a thermal transfer recording medium having a heat-fusible layer of a colorant and a binder of a polyurethane or polyether containing bisphenol units. However none of these binders contains an active epoxide since in one of the comparative examples, it was found that when an epoxide was the binder, "storage stability of the ink sheet was unsatisfactory, since the resin binder had a reactive epoxy group".

It is an object of this invention to provide a stabilizer for a dye-donor element to prevent density loss prior to use. It is another object of this invention to provide a stabilizer which will protect against selective loss of dye density when more than one dye is present in order to maintain a better color balance of the resulting print.

These and other objects are achieved in accordance with this invention which relates to a dye-donor element for thermal dye transfer comprising a support having thereon a dye layer comprising an image dye in a polymeric binder which is non-transferable by heat, and wherein the dye layer also contains an epoxide stabilizer, other than the binder, in an amount of up to about 25% by weight of the binder.

It is believed that the epoxide stabilizer of the invention functions to react with residual acid-producing moieties in the binder which would otherwise bring about degeneration of the image dyes and/or infrared-absorbing dye if one is present.

In a preferred embodiment of the invention, the expoxide stabilizer is present at a concentration of from about 5 to about 10% by weight.

In general, it has been found that epoxide compounds derived from natural oils and fats, such as epoxidized soybean oil, or epoxidized tall oils, as well as totally synthetic epoxy resins, such as those derived from bisphenol A and epichlorohydrin are effective in the practice of this invention. Solid epoxides are preferred because of a reduced tendency to migrate to the surface of the coating. In a preferred embodiment of the invention, the epoxide compound has the formula:

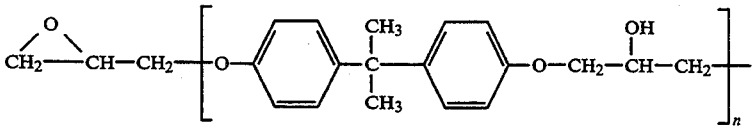

-continued

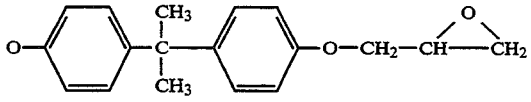

Bisphenol-A Epoxy Resin where n is from 0 to about 3.

Any dye can be used in the dye-donor employed in the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

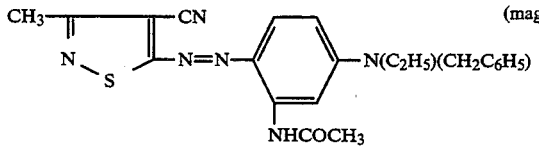

(magenta)

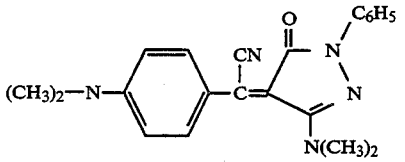

(magenta)

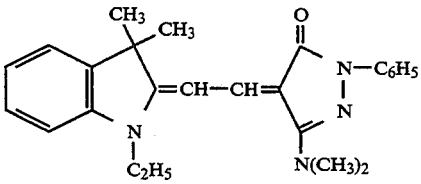

(yellow)

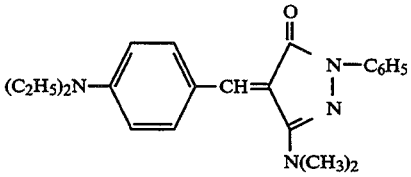

(yellow)

-continued

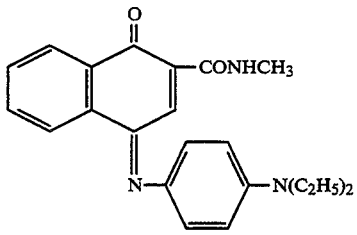

(cyan)

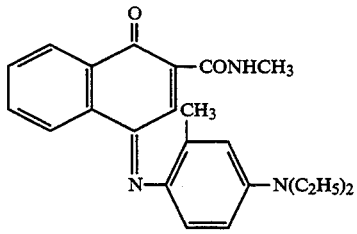

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144 by Vanier, Lum and Bowman.

The dye layer of the dye-donor element may be coated on the support or printed thereon by a printing technique such as a gravure process.

Any material can be used as the support for the dye-donor element of the invention provided it is dimensionally stable and can withstand the heat of the laser or thermal head. Such materials include polyesters such as poly(ethylene terephthalate); polyamides; polycarbonates; cellulose esters such as cellulose acetate; fluorine polymers such as polyvinylidene fluoride or poly(tetrafluoroethylene-cohexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. It may also be coated with a subbing layer, if desired, such as those materials described in U.S. Pat. Nos. 4,695,288 or 4,737,486.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate; polyvinyl acetate, poly(styrene-co-acrylonitrile), a poly(sulfone) or a poly(phenylene oxide). The binder may be used at a coverage of from about 0.1 to about 5 $g/m^2$.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface active agent. Preferred lubricating materials include oils or semi-crystalline organic solids that melt below 100° C. such as poly(vinyl stearate), beeswax, perfluorinated alkyl ester polyethers, poly(caprolactone), silicone oil, poly(tetrafluoroethylene), carbowax, poly(ethylene glycols), or any of those materials disclosed in U.S. Pat. Nos. 4,717,711; 4,717,712; 4,737,485; and 4,738,950. Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 $g/m^2$ If a polymeric binder is employed, the lubricating material is present in the range of 0.05 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone)-, a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as dupont Tyvek®. Pigmented supports such as white polyester (transparent polyester with white pigment incorporated therein) may also be used.

The dye image-receiving layer may comprise, for example, a polycarbonate, a polyurethane, a polyester, polyvinyl chloride, poly (styrene-co-acrylonitrile), poly (caprolactone), a poly (vinyl acetal) such as poly(vinyl alcohol-co-butyral), poly (vinyl alcohol-co-benzal ), poly (vinyl alcohol-co-acetal) or mixtures thereof. The dye image-receiving layer may be present in any amount which is effective for the intended purpose. In general, good results have been obtained at a concentration of from about 1 to about 5 $g/m^2$.

As noted above, the dye-donor elements of the invention are used to form a dye transfer image. Such a process comprises imagewise heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have alternating areas of dyes such as sublimable cyan and/or magenta and/or yellow and/or black or other dyes. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and magenta, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A laser may also be used to transfer dye from the dye-donor elements of the invention. When a laser is used, it is preferred to use a diode laser since it offers substantial advantages in terms of its small size, low cost, stability, reliability, ruggedness, and ease of modulation. In practice, before any laser can be used to heat a dye-donor element, the element must contain an infrared-absorbing material, such as carbon black, cyanine infrared absorbing dyes as described in U.S. Pat. No. 4,973,572, or other materials as described in the following U.S. Pat. Nos. 4,948,777, 4,950,640, 4,950,639, 4,948,776, 4,948,778, 4,942,141, 4,952,552 and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the image dyes, but also on the ability of the dye layer to absorb the radiation and convert it to heat. The infrared-absorbing material may be contained in the dye layer itself or in a separate layer associated therewith.

Lasers which can be used to transfer dye from dye-donors employed in the invention are available commercially. There can be employed, for example, Laser Model SDL-2420-H2 from Spectra Diode Labs, or Laser Model SLD 304 V/W from Sony Corp.

A thermal printer which uses the laser described above to form an image on a thermal print medium is described and claimed in copending U.S. application Ser. No. 451,656 of Baek and DeBoer, filed Dec. 18, 1989, the disclosure of which is hereby incorporated by reference.

Spacer beads may be employed in a separate layer over the dye layer of the dye-donor in the above-described laser process in order to separate the dye-donor from the dye-receiver during dye transfer, thereby increasing the uniformity and density of the transferred image. That invention is more fully described in U.S. Pat. No. 4,772,582, the disclosure of which is hereby incorporated by reference. Alternatively, the spacer beads may be employed in the receiving layer of the dye-receiver as described in U.S. Pat. No. 4,876,235, the disclosure of which is hereby incorporated by reference. The spacer beads may be coated with a polymeric binder if desired.

The use of an intermediate receiver with subsequent retransfer to a second receiving element may also be employed in the invention when used in color proofing. A multitude of different substrates can be used to prepare the color proof (the second receiver) which is preferably the same substrate used for the printing press run. Thus, this one intermediate receiver can be optimized for efficient dye uptake without dye-smearing or crystallization.

Examples of substrates which may be used for the second receiving element (color proof) include the following: Flo Kote Cove® (S. D. Warren Co.), Champion Textweb® (Champion Paper Co.), Quintessence Gloss® (Potlatch Inc.), Vintage Gloss® (Potlatch Inc.), Khrome Kote® (Champion Paper Co.), Ad-Proof Paper® (Appleton Papers, Inc.), Consolith Gloss® (Consolidated Papers Co.) and Mountie Matte® (Potlatch Inc.).

As noted above, after the dye image is obtained on a first dye-receiving element, it is retransferred to a second dye image-receiving element. This can be accomplished,. for example, by passing the two receivers between a pair of heated rollers. Other methods of retransferring the dye image could also be used such as using a heated platen, use of pressure and heat, external heating, etc.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

EXAMPLE 1

Black dye-donors were prepared by coating on a 100 μn thick poly(ethylene terephthalate) support a solution of high molecular weight cellulose acetate propionate (2.5% acetyl, 45% propionyl, intrinsic viscosity>1.8 dL/g) in an amount of 0.61 g/m$^2$, as described in copending U.S. Ser. No. 495,186 of Charles Buchanan, filed Mar. 19, 1990, the disclosure of which is hereby incorporated by reference; a mixture of the cyan, magenta and yellow dyes illustrated below at 0.22 g/m$^2$ each, the infrared absorbing dye shown below at 0.054 g/m$^2$ and invention or control additives described below from an 80:20 mixture of methyl isoamyl ketone and isobutanol.

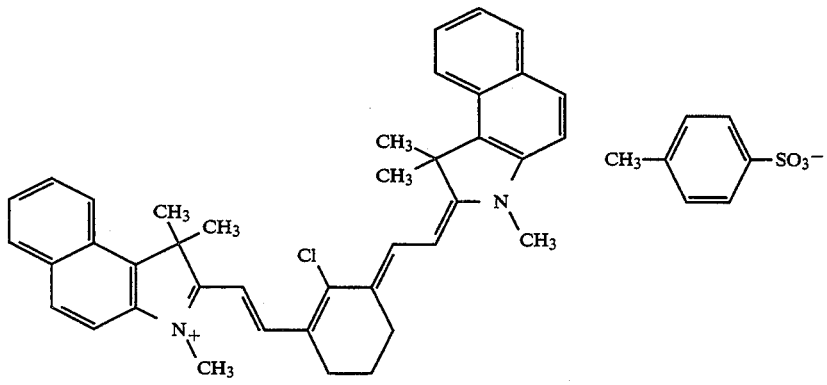

IR-ABSORBING DYE

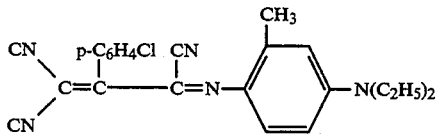

CYAN DYE

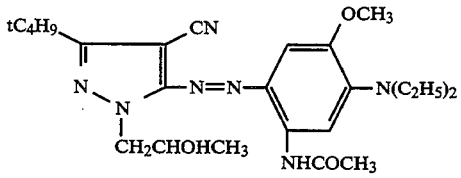

MAGENTA DYE

-continued

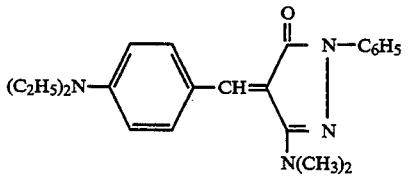

YELLOW DYE

The following invention epoxides were evaluated in the examples which follow:

E-1. D.E.R. 661, a low molecular weight solid resin derived from bisphenol A and epichlorohydrin. This material is approximately 7% epoxide and is available from the Dow Chemical Company, Midland, Mich.

E-2. D.E.R. 337, a low molecular weight semi-solid resin derived from bisphenol A and epichlorohydrin. This material is approximately 12% epoxide and is available from the Dow Chemical Company, Midland, Mich.

E-3. D.E.R. 331, a low molecular weight liquid resin derived from bisphenol A and epichlorohydrin. This material is approximately 20% epoxide and is available from the Dow Chemical Company, Midland, Mich.

E-4. Octyl epoxytallate, available from Union Carbide Corporation, Danbury, Conn. as Flexol Plasticizer EP-8. This is a monofunctional epoxide with an epoxide content of about 5%.

The following materials were evaluated as controls in the examples which follow:

C-1. Irganox B225, available from the Ciba-Geigy Corporation, Hawthorn, N.Y., described as a 50:50 mixture of tris(2,3-di-tert-butylphenyl)phosphite, and tetrakis[methylene (3,5-di-tert-butyl-4-hydroxyhydrocinnamate)]-methane.

C-2. Irganox 1010, available from the Ciba-Geigy Corporation, Hawthorn, N.Y., described by the manufacturer as tetrakis[methylene (3,5-di-tert-butyl-4-hydroxyhydrocinnamate)]methane.

C-3. Chimassorb 944FL, available from the Ciba-Geigy Corporation, Hawthorn, N.Y., and described by the manufacturer as N,N'-bis(2,2,6,6-tetramethyl-4-piperidinyl)-1,6-hexanediamine polymer with 2,4,6-trichloro-1,3,5-triazine and 2,4,4-trimethyl-1,2-pentanamine.

C-4. N,N-Dimethyl-octadecylamine, available from Humko Chemical Division of Witco Chemical Corporation, Memphis, Tenn. as Kemamine T-9902-D.

Densities of the dye-donors were measured at 840 nm in a spectrophotometer. The dye-donors were then subjected to an incubation test at 50° C. and 50% RH for four weeks. The densities were then measured again. The following results were obtained:

TABLE 1

| ADDITIVE ($g/m^2$) | INITIAL DENSITY | DENSITY AFTER INCUBATION | % LOSS |
|---|---|---|---|
| None | 1.01 | .85 | 16 |
| C-1 (.054) | 1.28 | .85 | 34 |
| C-1 (.108) | 1.19 | .87 | 27 |
| E-1 (.054) | 1.27 | 1.20 | 6 |
| E-4 (.108) | 1.30 | 1.30 | 0 |

TABLE 1-continued

| ADDITIVE ($g/m^2$) | INITIAL DENSITY | DENSITY AFTER INCUBATION | % LOSS |
|---|---|---|---|
| E-4 (.054) | 1.15 | 1.13 | 2 |
| E-4 (0.108) | 1.24 | 1.16 | 6 |

The above results indicate that the epoxide stabilizers of the invention are effective in minimizing density loss upon incubation.

EXAMPLE 2

This example was prepared as Example 1. The data collected consisted of Status A red transmission density measurements before and after incubation as in Example 1. Control compounds consisted of a hindered phenol (C-2), a hindered amine (C-3), and a tertiary amine (C-4) as an acid scavenger. Five data points for each reading were averaged to give the results shown in Table 2.

TABLE 2

| ADDITIVE ($g/m^2$) | INITIAL RED DENSITY | RED DENSITY AFTER INCUBATION | % LOSS |
|---|---|---|---|
| None | 2.00 | 1.68 | 16 |
| C-2 (.054) | 2.00 | 1.59 | 21 |
| C-2 (.108) | 2.00 | 1.61 | 20 |
| C-3 (.054) | 1.91 | 0.81 | 58 |
| C-3 (.108) | 1.93 | 0.30 | 85 |
| C-4 (.054) | 1.92 | 0.75 | 61 |
| C-4 (.108) | 1.86 | 0.23 | 88 |
| E-1 (.054) | 1.97 | 1.91 | 3 |
| E-1 (.108) | 2.04 | 2.00 | 2 |
| E-2 (.054) | 2.03 | 1.98 | 2 |
| E-2 (.108) | 2.05 | 2.00 | 2 |
| E-3 (.054) | 1.97 | 1.95 | 1 |
| E-3 (.108) | 2.04 | 1.98 | 3 |
| E-4 (.054) | 2.02 | 1.92 | 5 |
| E-4 (.108) | 2.00 | 1.77 | 12 |

This above data show the benefical effects of the invention epoxides at a relatively low coating coverage for stabilizing the dye-donors against density losses.

EXAMPLE 3

This example compares a variety of polymeric binders for density losses with no additives and with the invention epoxides at a low coating level. Dye-donors were prepared and tested as in Example 1 except that the following binders were used:

B-1. CAP482-.5, Cellulose acetate propionate, 0.5 second viscosity, available from Tennessee Eastman Company, Kingsport, Tenn., and coated from 70:30 methyl isobutyl ketone and ethanol.

B-2. CAP 482-20, Cellulose acetate propionate, 20 second viscosity, available from the Tennessee Eastman Company, Kingsport, Tenn., and coated from 70:30 methyl isobutyl ketone and ethanol.

B-3. HIGH IV CAP, (High viscosity cellulose acetate propionate) prepared according to U.S. Ser. No. 495, 186, filed Mar. 19, 1990, and coated from 70:30 methyl isobutyl ketone and ethanol.

B-4. Nitrocellulose, grade RS 30-40 second viscosity, obtained from the Aqualon Corporation, Wilmington Del., and coated from 70:30 methyl isobutyl ketone and ethanol.

B-5. Butvar B-72 ® poly(vinyl butyral) resin obtained from the Monsanto Corporation, St. Louis, Mo., and coated from 70:30 methyl isobutyl ketone and ethanol.

B-6. Polystyrene, approximate MW 280,000, obtained from Scientific Polymer Products, Ontario, N.Y., as catalog number 039A, and coated from an 80:20 mixture of 2-butanone and dichloromethane.

B-7. Vylon 200 ® polyester obtained from Toyoho KK and coated from a 70:30 mixture of dichloromethane and 1,1,2-trichloroethane. The following results were obtained:

TABLE 3

| BINDER ($g/m^2$) | INITIAL RED STATUS A TRANS. DENSITY | DENSITY AFTER INCUBATION | % LOSS |
|---|---|---|---|
| B-1 | 2.14 | 1.94 | 9.4% |
| B-1 + E-1 | 2.22 | 2.17 | 2.3% |
| B-2 | 2.30 | 2.05 | 10.9% |
| B-2 + E-1 | 2.14 | 2.08 | 2.8% |
| B-3 | 2.22 | 1.58 | 28.8% |
| B-3 + E-1 | 2.24 | 2.12 | 5.3% |
| B-4 | 2.24 | 2.05 | 8.5% |
| B-4 + E-1 | 2.33 | 2.22 | 4.7% |
| B-5 | 2.18 | 1.91 | 12.4% |
| B-5 + E-1 | 2.27 | 2.21 | 2.6% |
| B-6 | 2.72 | 2.52 | 7.4% |
| B-6 + E-1 | 2.68 | 2.67 | 0.4% |
| B-7 | 2.15 | 2.03 | 5.6% |
| B-7 + E-1 | 2.27 | 2.24 | 1.3% |

The data in Table 3 illustrate that a variety of dye-binders can be stabilized against density loss with one of the invention epoxides.

EXAMPLE 4

The following example illustrates that the invention compounds are effective for stabilizing dyes in resistive head thermal print media, with various dyes and binders, and at relatively low coating levels.

Resistive head dye-donors were prepared by coating on both sides of a 6 μm poly(ethylene terephthalate) support a solution of Tyzor TBT ® (titanium alkoxide available from DuPont Chemical Corp.) in n-butanol to obtain a coverage of 0.10 $g/m^2$ on each side. On one side of the support, a slipping layer consisting of a dispersion of fine particles of polytetrafluoroethylene dispersed in a nitrocellulose binder was coated at a dry coverage of 0.54 $g/m^2$. This dispersion is commercially available from Acheson Colloids Company under the tradename Emralon 329 ®. The solvent used for this application was a four component blend available from Acheson known as SB-1.

On the dye side of the support were coated solutions of the yellow dye of Example 1 (0.22 $g/m^2$), or the cyan dye #2 illustrated below (0.32 $g/m^2$), from the solvents and polymeric binders listed below (0.54 $g/m^2$). The binders employed were the same as those used in Examples 1, 2 and 3, with the additions or changes as noted.

B-8. Polystyrene was Catalog #400, from Scientific Polypher Products, Ontario, N.Y. This binder with the dyes was coated from an 80:20 blend of 2-butanone and dichloromethane.

B-9. Poly(methyl methacrylate) was Chemical #04942P, obtained from Kodak Laboratory Chemicals, Rochester, N.Y., and coated from an 80:20 blend of 2-butanone and dichloromethane.

B-10. Polyvinyl chloride was obtained from Scientific Polymer Products, Ontario, N.Y. and was identified as Catalog #354. The coating solvent was tetrahydrofuran.

B-11. Ethyl cellulose was product HE350H, obtained from Dow Chemical Company, Midland, Mich. and coated from a 70:30 blend of methyl isobutyl ketone and ethanol.

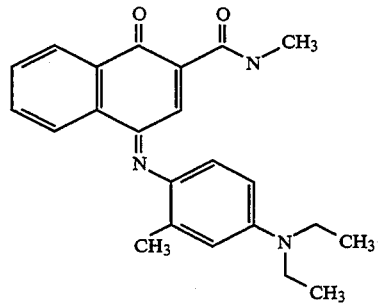

CYAN DYE #2

Each individual coating was accompanied by at least one coating with an invention epoxide as a stabilizer.

TABLE 4

| BINDER ($g/m^2$) | DYE | DENSITY FRESH | DENSITY AFTER INCUBATION | % LOSS |
|---|---|---|---|---|
| B-3 + | YELLOW | 2.42 | 2.23 | 7.8% |
| E-1 (.022) | YELLOW | 2.36 | 2.31 | 2.1% |
| E-1 (.054) | YELLOW | 2.41 | 2.37 | 1.7% |
| E-1 (.110) | YELLOW | 2.42 | 2.39 | 1.2% |
| B-1 + | YELLOW | 2.35 | 2.17 | 7.7% |
| E-1 (.022) | YELLOW | 2.43 | 2.37 | 2.5% |
| E-1 (.054) | YELLOW | 2.41 | 2.34 | 2.9% |
| B-2 + | YELLOW | 2.42 | 2.25 | 7.0% |
| E-1 (.022) | YELLOW | 2.38 | 2.34 | 1.7% |
| B-9 + | YELLOW | 2.36 | 2.29 | 3.0% |
| E-1 (.022) | YELLOW | 2.39 | 2.35 | 1.7% |
| B-7 + | YELLOW | 2.21 | 2.16 | 2.2% |
| E-1 (.022) | YELLOW | 2.25 | 2.21 | 1.8% |
| B-8 + | YELLOW | 2.16 | 2.01 | 6.9% |
| E-1 (.022) | YELLOW | 2.17 | 2.13 | 1.8% |
| B-4 + | YELLOW | 2.17 | 2.07 | 4.6% |
| E-1 (.022) | YELLOW | 2.16 | 2.11 | 2.3% |
| B-5 + | YELLOW | 2.39 | 2.07 | 13.3% |
| E-1 (.022) | YELLOW | 2.35 | 2.29 | 2.6% |
| B-10 + | YELLOW | 2.51 | 2.41 | 4.0% |
| E-1 (.022) | YELLOW | 2.52 | 2.47 | 2.0% |
| B-3 + | CYAN #2 | 1.60 | 1.58 | 1.3% |
| E-1 (.022) | CYAN #2 | 1.58 | 1.57 | 0.6% |
| B-5 + | CYAN #2 | 1.56 | 1.54 | 1.3% |
| E-1 (.022) | CYAN #2 | 1.52 | 1.51 | 0.6% |
| B-10 + | CYAN #2 | 1.55 | 1.54 | 0.6% |
| E-1 (.022) | CYAN #2 | 1.50 | 1.50 | 0.0% |

The results in Table 4 illustrate the utility of the invention epoxide in stabilizing a variety of polymeric binders and dyes.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side a dye layer comprising an image dye in a polymeric binder, said binder being non-transferable by heat and consisting of a cellulose derivative, a polycarbonate, polyvinyl acetate, poly(styrene-co-acrylonitrile), a polysulfone or a poly(phenylene oxide), the improvement wherein said dye layer also contains an epoxide compound which acts as a dye stabilizer, other than said binder, in an amount of up to about 25% by weight of said binder, and either a) an infrared-absorbing material is contained in said dye layer or a layer associated therewith, or b) the other side of the support has a slipping layer thereon.

2. The element of claim 1 wherein said epoxide compound is present at a concentration of from about 5 to about 10% by weight.

3. The element of claim 1 wherein said binder comprises cellulose acetate propionate.

4. In a process of forming a thermal dye transfer image comprising:

a) contacting at least one dye-donor element comprising a support having on one side a dye layer comprising an image dye in a polymeric binder, said binder being non-transferably by heat and consisting of a cellulose derivative, a polycarbonate, polyvinyl acetate, poly(styrene-co-acrylonitrile), a polysulfone or a poly(phenylene oxide), with a dye-receiving element comprising a support having thereon a polymeric dye image-receiving layer;

b) imagewise-heating said dye-donor element; and c) transferring a dye image to said dye-receiving element to form said thermal dye transfer image, the improvement wherein said dye layer also contains an epoxide compound which acts as a dye stabilizer, other than said binder, in an amount of up to about 25% by weight of said binder, and either a) an infrared-absorbing material is contained in said dye layer or a layer associated therewith, or b) the other side of the support has a slipping layer thereon.

5. The process of claim 4 wherein said epoxide compound is present at a concentration of from about 5 to about 10% by weight.

6. The process of claim 4 wherein said binder comprises cellulose acetate propionate.

7. In a thermal dye transfer assemblage comprising:

(a) a dye donor element comprising a support having on one side a dye layer comprising an image dye dispersed in a polymeric binder, said binder being non-transferably by heat and consisting of a cellulose derivative, a polycarbonate, polyvinyl acetate, poly(styrene-co-acrylonitrile), a polysulfone or a poly(phenylene oxide), and (b) a dye-receiving element comprising a support having thereon a dye image-receiving layer, said dye-receiving element being in superposed relationship with said dye-donor element so that said dye layer is in contact with said dye image-receiving layer, the improvement wherein said dye layer also contains an epoxide compound which acts as a dye stabilizer, other than said binder, in an amount of up to about 25% by weight of said binder, and either a) an infrared-absorbing material is contained in said dye layer or a layer associated therewith, or b) the other side of the support has a slipping layer thereon.

8. The assemblage of claim 7 wherein said epoxide compound is present at a concentration of from about 5 to about 10% by weight.

9. The assemblage of claim 7 wherein said binder comprises cellulose acetate propionate.

* * * * *